US005823200A

United States Patent [19]

Persaud

[11] Patent Number: 5,823,200

[45] Date of Patent: Oct. 20, 1998

[54] TOBACCO SMOKE ABATEMENT SYSTEM

[76] Inventor: Kharanan Persaud, 142 Atkins Circle, Brampton Ontario, Canada, L6X 4A8

[21] Appl. No.: 772,583

[22] Filed: Dec. 26, 1996

[51] Int. Cl.[6] ..... A24B 15/00

[52] U.S. Cl. ..... 131/331; 454/306; 98/39

[58] Field of Search ..... 98/39, 37; 454/306, 454/256, 49, 230; 99/468; 131/331

[56] References Cited

U.S. PATENT DOCUMENTS 4,380,187 4/1983 Wicks ..... 98/39

5,163,360 11/1992 Petz ..... 99/468

5,360,374 11/1994 Wyon et al. ..... 454/306

*Primary Examiner*—Aaron J. Lewis

*Assistant Examiner*—Charles W. Anderson

[57] ABSTRACT

A new Tobacco Smoke Abatement System for moving and dissipating tobacco smoke in an enclosed environment. The inventive device includes an air distribution manifold on an item of furniture and a system to supply compressed air to the manifold.

9 Claims, 3 Drawing Sheets

TOBACCO SMOKE ABATEMENT SYSTEM

BACKGROUND OF THE INVENTION

1. Field of the Invention

The present invention relates to smoke removal systems and more particularly pertains to a new Tobacco Smoke Abatement System for moving and dissipating tobacco smoke in an enclosed environment.

2. Description of the Prior Art

The use of smoke removal systems is known in the prior art. More specifically, smoke removal systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art smoke removal systems include U.S. Pat. No. 5,306,207; U.S. Pat. No. 4,623,367; U.S. Pat. No. 3,890,126; U.S. Pat. No. 4,559,955 and U.S. Pat. No. 3,895,570.

While these devices fulfill their respective, particular objectives and requirements, the aforementioned patents do not disclose a new Tobacco Smoke Abatement System. The inventive device includes an air distribution manifold on an item of furniture and a system to supply compressed air to the manifold.

In these respects, the Tobacco Smoke Abatement System according to the present invention substantially departs from the conventional concepts and designs of the prior art, and in so doing provides an apparatus primarily developed for the purpose of moving and dissipating tobacco smoke in an enclosed environment.

SUMMARY OF THE INVENTION

In view of the foregoing disadvantages inherent in the known types of smoke removal systems now present in the prior art, the present invention provides a new Tobacco Smoke Abatement System construction wherein the same can be utilized for moving and dissipating tobacco smoke in an enclosed environment.

The general purpose of the present invention, which will be described subsequently in greater detail, is to provide a new Tobacco Smoke Abatement System apparatus and method which has many of the advantages of the smoke removal systems mentioned heretofore and many novel features that result in a new Tobacco Smoke Abatement System which is not anticipated, rendered obvious, suggested, or even implied by any of the prior art smoke removal systems, either alone or in any combination thereof.

To attain this, the present invention generally comprises an air distribution manifold on an item of furniture and a system to supply compressed air to the manifold.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Tobacco Smoke Abatement System apparatus and method which has many of the advantages of the smoke removal systems mentioned heretofore and many novel features that result in a new Tobacco Smoke Abatement System which is not anticipated, rendered obvious, suggested, or even implied by any of the prior art smoke removal systems, either alone or in any combination thereof.

It is another object of the present invention to provide a new Tobacco Smoke Abatement System which may be easily and efficiently manufactured and marketed.

It is a further object of the present invention to provide a new Tobacco Smoke Abatement System which is of a durable and reliable construction.

An even further object of the present invention is to provide a new Tobacco Smoke Abatement System which is susceptible of a low cost of manufacture with regard to both materials and labor, and which accordingly is then susceptible of low prices of sale to the consuming public, thereby making such Tobacco Smoke Abatement System economically available to the buying public.

Still yet another object of the present invention is to provide a new Tobacco Smoke Abatement System which provides in the apparatuses and methods of the prior art some of the advantages thereof, while simultaneously overcoming some of the disadvantages normally associated therewith.

Still another object of the present invention is to provide a new Tobacco Smoke Abatement System for moving and dissipating tobacco smoke in an enclosed environment.

Yet another object of the present invention is to provide a new Tobacco Smoke Abatement System which includes an air distribution manifold on an item of furniture and a system to supply compressed air to the manifold.

Still yet another object of the present invention is to provide a new Tobacco Smoke Abatement System that efficiently and unobtrusively increases the rate at which tobacco smoke is extracted from buildings.

Even still another object of the present invention is to provide a new Tobacco Smoke Abatement System that does not detract from the building decor.

Even still another object of the present invention is to provide a new Tobacco Smoke Abatement System that improves building air quality and reduces the presence of second hand smoke.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
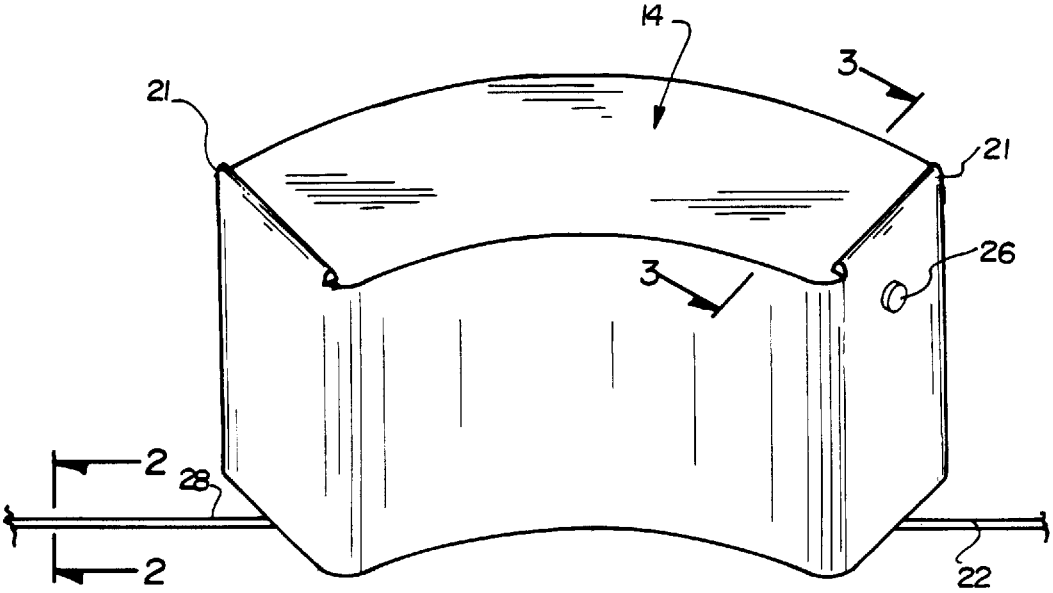
FIG. 1 is a perspective view of a new Tobacco Smoke Abatement System incorporated into an exemplary gaming table according to the present invention.

With reference now to the drawings, and in particular to FIGS. 1 through 6 thereof, a new Tobacco Smoke Abatement System embodying the principles and concepts of the present invention and generally designated by the reference numeral 10 will be described.

More specifically, it will be noted that the Tobacco Smoke Abatement System 10 comprises an air distribution system 20 having an air distribution manifold 21 mounted in a gaming table 14, an air supply line 22, and a source 23 of air. Although the invention is illustrated as being used on gaming tables in a casino to show the inventive concept, the invention could be used on other items of furniture in other environments, such as eating and drinking establishments, offices, and other similar environments.

As best illustrated in FIGS. 1 through 6, it is shown that the air distribution system 20 is suitably provided within a building 18 for providing air to the gaming tables 14 and/or gaming machines 14*a–b,* such as roulette and slots machines, located within the building. As illustrated in FIGS. 1–5, the gaming table 14 includes an air manifold 21 incorporated into each end of the upper surface of the table. The manifolds are provided so as to minimally detract from the appearance of the table, thus providing a pleasing appearance. A plurality of air distribution holes 27 are provided in each manifold to provide an outlet for pressurized air. The manifolds 21 and holes 27 are disposed such that when air is discharged from the holes, the exiting air directs tobacco smoke upwards and away from the gaming table towards the ceiling of the building, where an existing smoke extraction system of the building then removes the smoke.

The manifolds 21 are supplied with compressed air through a main supply line 22 and internal supply lines 22*a* within the table. An air regulating valve 26 is disposed within the supply line 22 to regulate the supply of air to the manifolds. Alternatively, a regulating valve could also be provided in the internal supply lines 22*a,* as well as the supply line 22, to individually control the air supply to each manifold. The manifolds 21 and supply lines 22,22*a* are suitably connected to each other to prevent air leakage, as would be understood by one having ordinary skill in the art.

Figure 2:
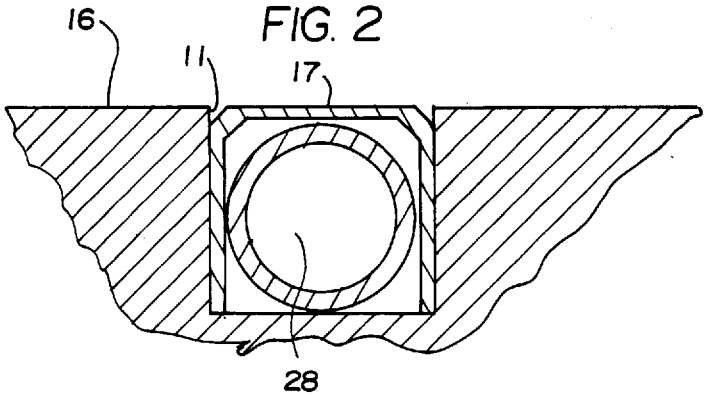
FIG. 2 is a section view along line 2—2 or FIG. 1 showing an air line mounted in a floor of the building.
Figure 3:
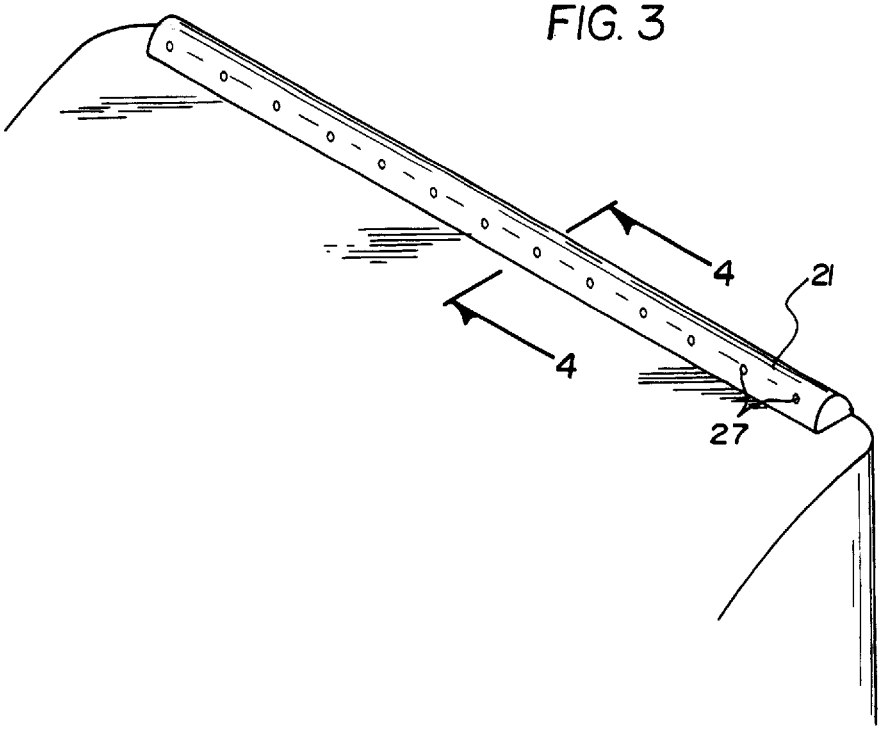
FIG. 3 is a sectional view along line 3—3 of FIG. 1 showing an air manifold incorporated into one end of the gaming table.
Figure 4:
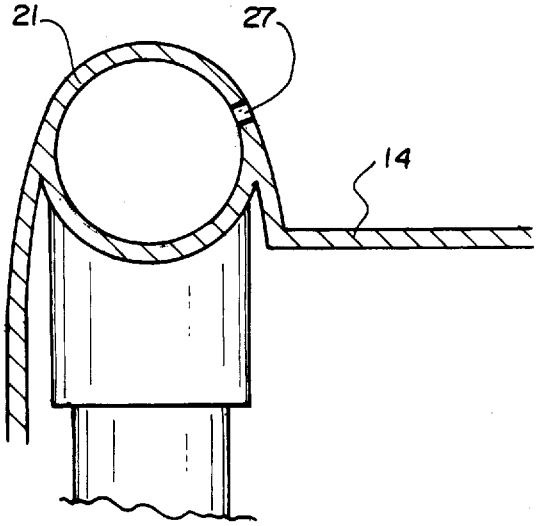
FIG. 4 is a sectional view along line 4—4 of FIG. 3.
Figure 5:
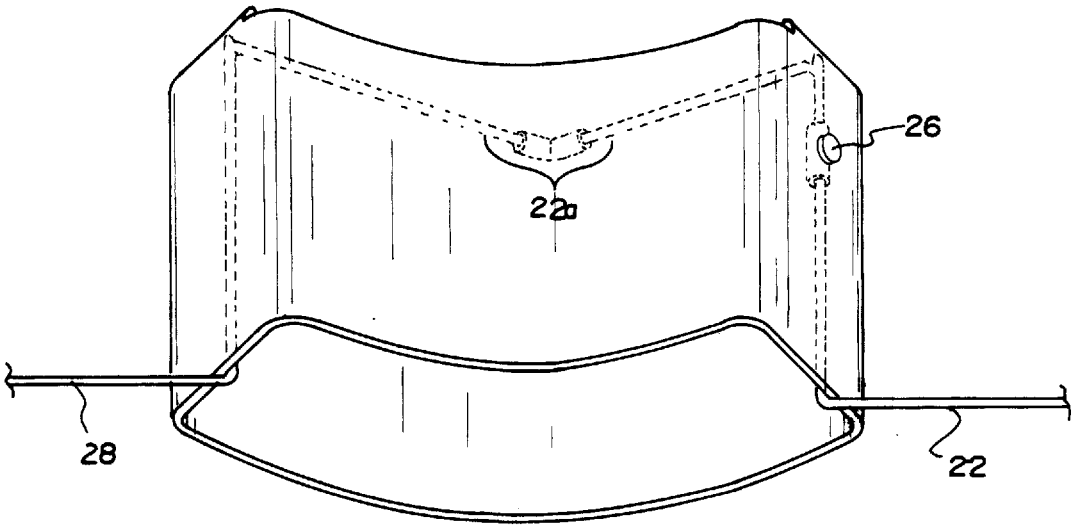
FIG. 5 is a bottom perspective view of the gaming table showing portions of the air supply system.

An air line 28 can lead from the supply lines 22,22*a* to supply air to further gaming tables. As seen in FIG. 2, the lines 22,28 can be disposed within channels 11 in the floor 16, in order to hide the lines from view. The channels are then covered by removable covers 17, in order to protect the lines.

The air distribution system 20 also includes an air compressor 23 fluidly connected with the air supply line 22, as the source of compressed air. The air compressor 23 communicates with an air reservoir 24 disposed in the supply line 22, providing a reservoir of compressed air. Water filter 25 is also disposed in the supply line, in order to remove residual water from the compressed air. The actual location in the building of the compressor, reservoir, and water filter are up to individual preference, but should be located so as to provide access for maintenance.

Figure 6:
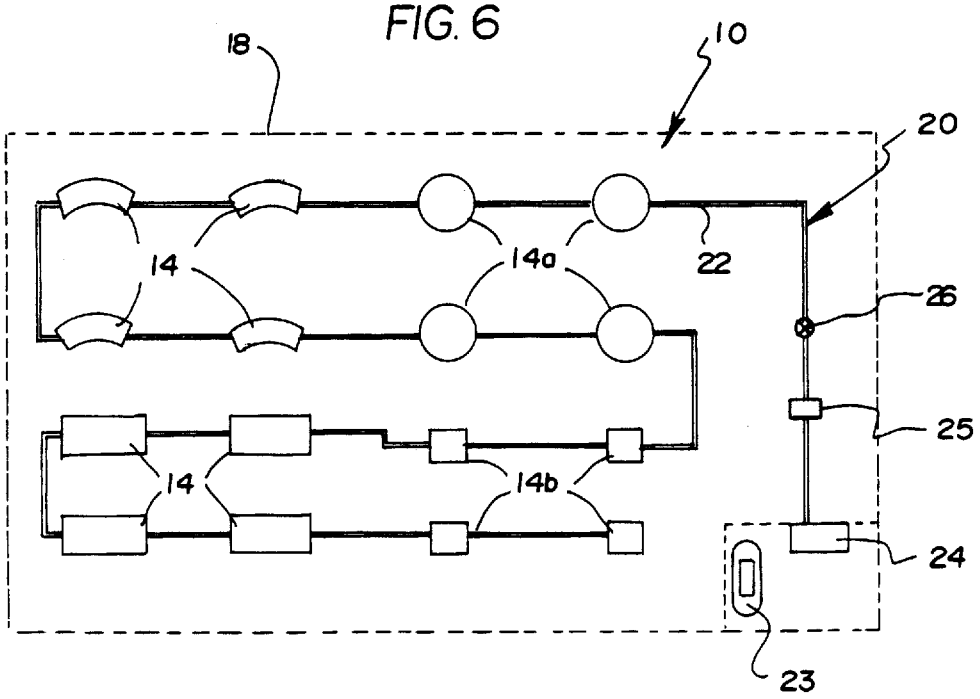
FIG. 6 is an overview of the overall building with a plurality of different gaming tables incorporated into the air supply system.

As shown in FIG. 6, a plurality of gaming tables and machines 14,14*a–b* can be connected to main supply line 22 to be supplied with compressed air from the compressor 23. Regulating valve 26 regulates the supply of compressed air to all of the tables and machines. Alternatively, a regulating valve could be provided for each table and machine to individually control air supply to each table and machine.

In use, compressor 23 is turned on to generate compressed air. The user then turns the regulating valve 26 to an "on" position, thus allowing air flow to the manifolds. Air then exits the holes in the manifolds, which causes the offending tobacco smoke to move toward the ceiling of the building where it is then removed by the buildings extraction system. If the user does not desire smoke removal at a particular table or machine, the appropriate regulating valve is turned to an "off" position, thus preventing air flow to the manifolds and out of the holes.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Tobacco Smoke Abatement System comprising:

a first item of furniture located within an enclosed structure, the first item of furniture having outward facing surfaces;

an air distribution system operatively associated with the first furniture item;

said air distribution system including at least one air distribution manifold having air distribution holes located on at least one of the outward facing surfaces of the first furniture item, a first air supply line in fluid communication with said manifold, and an air compressor in fluid communication with the first supply line to provide compressed air to the manifold; and said manifold being operatively positioned on the first furniture item such that air exiting the distribution holes facilitates movement of tobacco smoke upwardly and away from the first furniture item.

2. The Tobacco Smoke Abatement System of claim 1, further comprising an air reservoir in the first supply line between the compressor and the manifold.

3. The Tobacco Smoke Abatement System of claim 2, further comprising a water filter in the first supply line between the air reservoir and the manifold.

4. The Tobacco Smoke Abatement System of claim 3, further comprising an air regulating valve disposed in the first supply line between the water filter and the manifold, in order to regulate the air supply to the manifold.

5. The Tobacco Smoke Abatement System of claim 1, wherein there are a plurality of said air distribution manifolds disposed on the furniture item.

6. The Tobacco Smoke Abatement System of claim 1, wherein there is at least one further furniture item, said further furniture item having at least one of said air distribution manifolds, and comprising a further air supply line leading from the first air supply line to the at least one manifold on the further furniture item.

7. The Tobacco Smoke Abatement System of claim 6, further comprising an air regulating valve in the further air supply line.

8. A Tobacco Smoke Abatement System comprising:

a plurality of items of furniture located within an enclosed structure, each furniture item having outward facing surfaces;

an air distribution system operatively associated with the furniture items;

said air distribution system including a plurality of air distribution manifolds, at least one distribution manifold associated with at least one of the outward facing surfaces of each respective furniture item, each manifold having air distribution holes, air supply lines in fluid communication with each said manifold, an air compressor and air reservoir in fluid communication with the air supply lines to provide compressed air to the manifolds, a water filter in one of the lines between the air reservoir and one of the manifolds, and air regulating valves in the supply lines in order to regulate air supply to each furniture item; and said manifolds being operatively positioned on the furniture items such that air exiting the distribution holes facilitates movement of tobacco smoke upwardly and away from the furniture items, for removal by a smoke extraction system of the enclosed structure.

9. A method of directing tobacco smoke upwards and away from an item of furniture disposed in an enclosed structure for extraction of the smoke by a smoke extraction system of the structure, comprising:

disposing an air distribution manifold having air distribution holes on an upper surface of the furniture item;

providing an air supply line in fluid communication with the manifold;

connecting an air compressor, air reservoir, water filter, and air regulating valve to the supply line in order to selectively provide a flow of air to the manifold;

positioning the manifold and its associated distribution holes on the upper surface of the furniture item such that air exiting the holes facilitates movement of tobacco smoke upwardly and away from the furniture item for extraction by the smoke extraction system of the structure.

* * * * *